US005183001A

United States Patent [19]

Stranzinger

[11] Patent Number: 5,183,001

[45] Date of Patent: Feb. 2, 1993

[54] FLOAT

[76] Inventor: Margarete Stranzinger, Gitzen 16, A-5322 Hof bei Salzburg, Austria

[21] Appl. No.: 748,640

[22] Filed: Aug. 22, 1991

[30] Foreign Application Priority Data

Aug. 23, 1990 [AT] Austria ..... 1734/90

[51] Int. Cl.[5] ..... B63B 3/08

[52] U.S. Cl. ..... 114/266; 114/267

[58] Field of Search ..... 114/263, 264, 266, 267, 114/77 R; 441/44, 45; 404/40; D12/316; 14/27; 405/212, 215, 218, 219

[56] References Cited

U.S. PATENT DOCUMENTS

| | | | |
|---|---|---|---|
| 3,179,076 | 4/1965 | Sheffield | 114/267 |
| 3,822,499 | 7/1974 | De Vos | 114/267 |
| 4,098,214 | 7/1978 | Orvra | 114/267 |
| 4,286,538 | 9/1981 | Matsui | 114/266 |
| 4,604,962 | 8/1986 | Guibault | 114/266 |
| 4,733,626 | 3/1988 | Svirklys | 114/266 |

FOREIGN PATENT DOCUMENTS

| | | | |
|---|---|---|---|
| 312039 | 8/1971 | Austria . | |
| 325094 | 5/1973 | Austria . | |
| 1222166 | 2/1985 | Canada | 114/266 |

*Primary Examiner*—Joseph F. Peters, Jr.

*Assistant Examiner*—Clifford T. Bartz

*Attorney, Agent, or Firm*—Kurt Kelman

[57] ABSTRACT

A float having a substantially prismatic and preferably parallelepipedic body, which has corner edge portions provided with corner-connecting elements having eyes and recesses for receiving and interlocking with connecting bolts for connecting a plurality of identical floats in an assembly. In order to increase the strength and stability of the joints between such floats in an assembly consisting of a plurality of layers of such floats, the body of the float is formed at its center with a vertical retaining opening. The opening is adapted to receive a connecting bolt and contains a recessed bearing surface that is engageable by such bolt, a plurality of identical ones of said floats are adapted to be arranged in a plurality of layers in an assembly. In the assembly, the floats of adjacent layers are offset in the direction of a diagonal extending in each float from its central opening to the eyes of one of its corner-connecting elements so that such eyes of one of said adjacent layers and said retaining openings of the other of said layers are vertically aligned. Layer-connecting bolts extend each through at least two of said layers in one of said vertically aligned central openings and eyes and are supported at the recesses associated with the eyes and engage the bearing surfaces in said central openings.

9 Claims, 2 Drawing Sheets

FLOAT

BACKGROUND OF THE INVENTION

1. Field of the Invention

This invention relates to a float comprising a substantially prismatic and preferably parallelepipedic body, which has corner edge portions provided with corner-connecting elements having eyes and recesses for receiving and interlocking with connecting bolts for connecting a plurality of identical floats in an assembly.

2. Description of the Prior Art

Such floats are known, e.g., from Austrian Patent Specification 312,039 and can be assembled to form floating platforms and landing stages, but also man-carrying platforms, transport rafts, bridges, oil and dirt barriers, and owing to their wide field of application have achieved a very good commercial success. In order to permit the use of such floats in platforms or other assemblies having a high carrying capacity, it has also been proposed in Austrian Patent Specification 325,094 to arrange the floats in superimposed layers so that corresponding floats of adjacent layers are vertically aligned and sufficiently long layer-connecting bolts are provided for connecting the corner-connecting portions of the vertically aligned floats. But owing to that vertical alignment of the joints the floats of the platform or other assembly consisting of two of or more layers have a certain freedom of relative movement and the joints between the floats are highly stressed so that instabilities must be tolerated and the connecting elements may even be damaged under relatively high loads.

SUMMARY OF THE INVENTION

It is an object of the invention to eliminate the above-mentioned disadvantages and to provide a float which is of the kind described first hereinbefore and which is particularly suitable for use in assemblies which consist of two or more layers and in which the floats of superimposed layers are connected by joints which have a high stability and a high carrying capacity.

That object is accomplished in accordance with the invention in that the body of the float is formed at its center with a vertical retaining opening, which is adapted to receive a connecting bolt and contains a recessed bearing surface that is engageable by such bolt, a plurality of identical ones of said floats are adapted to be arranged in a plurality of layers in an assembly, in which the floats of adjacent layers are offset in the direction of a diagonal extending in each float from its central opening to the eyes of one of its corner-connecting elements so that such eyes of one of said adjacent layers and said retaining openings of the other of said layers are vertically aligned, and layer-connecting bolts extend each through at least two of said layers in one of said vertically aligned central openings and eyes and are supported at the recesses associated with the eyes and engage the bearing surfaces in said central openings. Because the layers of floats are laterally offset, the joints of the floats of one layer are supported by a float of the next lower layer and the floats are firmly interconnected. The layer-connecting bolts will be locked at the eyes of the floats of one layer and in the retaining opening of floats of the adjacent lower or upper layer so that the corner-connecting joints of the floats of one layer will be reinforced and the superimposed layers of floats will be forced against each other. This arrangement constitutes the desirable assembly, which has a high carrying capacity and high stability and in which a relative movement of the floats is prevented, and may constitute a floating platform or another assembly.

If the retaining opening may contain a bearing ring, which constitutes the recessed bearing surface and has an internal cross-section that conforms to the cross-sectional shape of the eyes, it will be possible to use simple connecting bolts, which carry identical locking cams or other lateral projections for interlocking with the recesses associated with the eyes and formed in the bearing surfaces disposed in the central openings so that the bolts can axially be inserted into the eyes and retaining openings and can then be rotated to a position in which they are locked in the eyes and in the retaining openings.

It will be particularly desirable to provide such a float in which the body consists of a hollow ring, which defines the retaining opening because such a hollow ring can economically be made, preferably of plastic, and even if it has only a small wall thickness can be used in an assembly having a high carrying capacity. The strength of the hollow body may be increased in that the hollow body is filled with foam, which will also prevent an ingress of water through a leak which may be formed in the hollow body.

DETAILED DESCRIPTION OF THE PREFERRED EMBODIMENT

Figure 1:
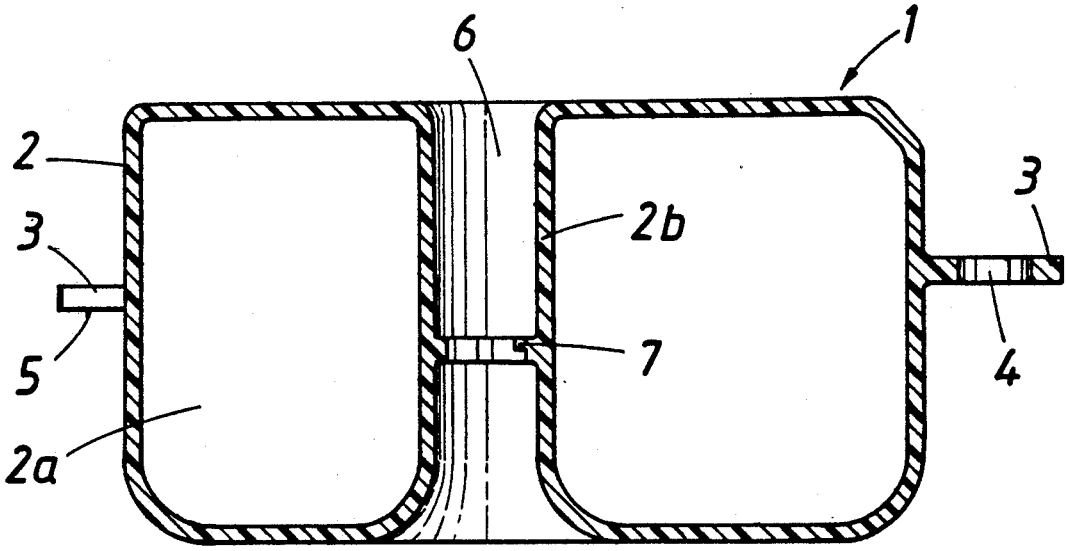
FIGS. 1 and 2 show a float in accordance with the invention and are, respectively, a vertical sectional view taken on line I—I in FIG. 2 and a top plan view.
Figure 2:
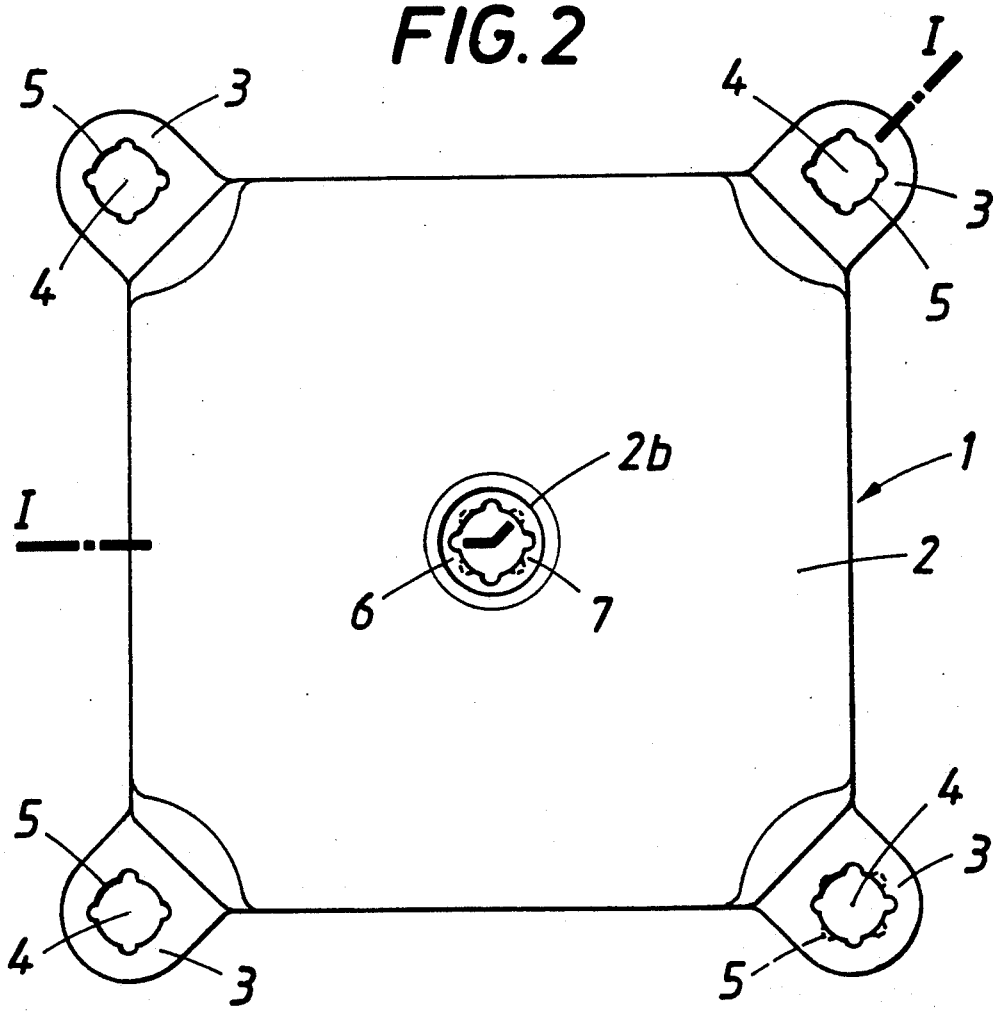

A float according to the invention and an assembly of such floats will now be described more in detail with reference to the strictly schematic drawing.

A float 1 in accordance with the invention consists of a substantially parallelepipedic body 2, which at its corner edge portions is provided with lugs or other corner-connecting elements 3, which are formed with eyes 4 and have bottom surfaces formed with recesses 5. The body 1 is formed at its center with a vertical retaining opening 6, which extends through the body 1 and contains a bearing ring 7, which has a recessed bottom surface. The retaining opening 6 is adapted to receive a layer-connecting bolt 11, which engages the bottom surface of the bearing ring 7 and is used to connect the float 1 to identical other floats. The body 2 consists of a hollow ring **2*a*, which is closed in itself and has an inside peripheral wall 2*b* that defines the retaining opening 6. Such a float can economically be manufactured and has a high carrying capacity. The hollow ring 2*a*** may be filled with foam to increase its strength and dimensional stability.

To assemble a plurality of floats 1 in one layer, the floats are juxtaposed in rows and columns and because the corner-connecting elements 3 of adjacent corners of adjacent floats 1 are suitable vertically offset a connecting bolt 8 can be inserted through the eyes 4 of such corner-connecting elements at four adjacent corners of respective floats 1, which are thus positively connected to each other. To that end a locking cam 9 formed on the connecting bolt 8 is locked in the recesses 5 of the lowermost corner-connecting element 3. Such a joint is illustrated for the lowermost layer of 10 of floats in the illustrative embodiment shown in FIGS. 3 and 4.

Figure 3:
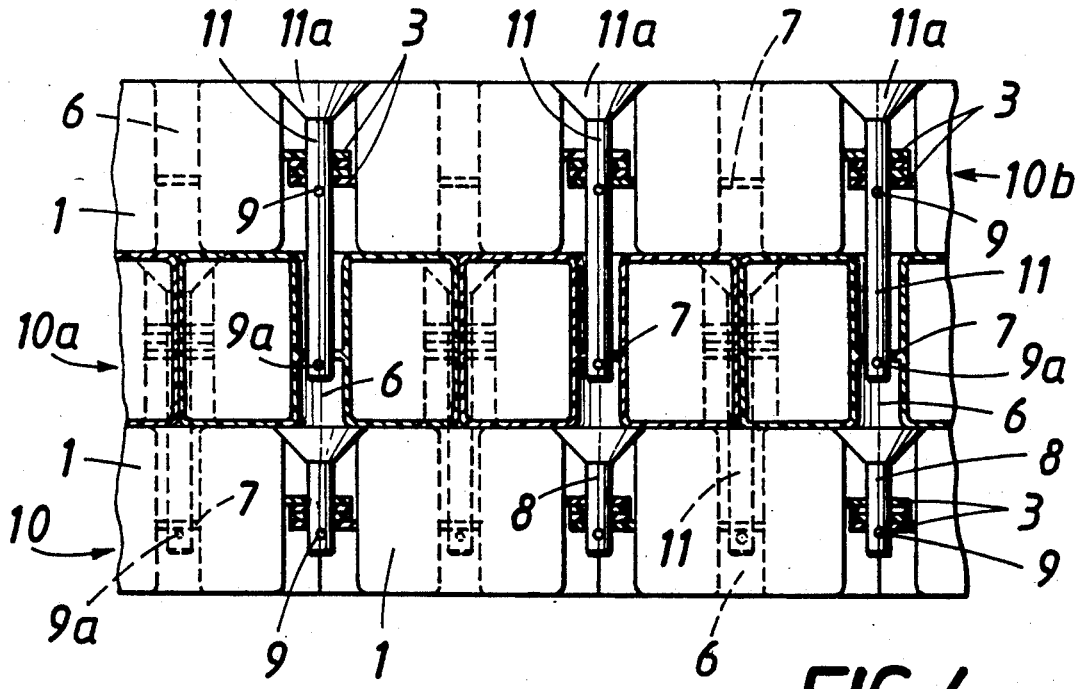
FIGS. 3 and 4 are fragmentary views showing a portion of a multilayer platform assembled from such floats and are, respectively, a vertical sectional view taken on line III—III in FIG. 4 and a top plan view.
Figure 4:
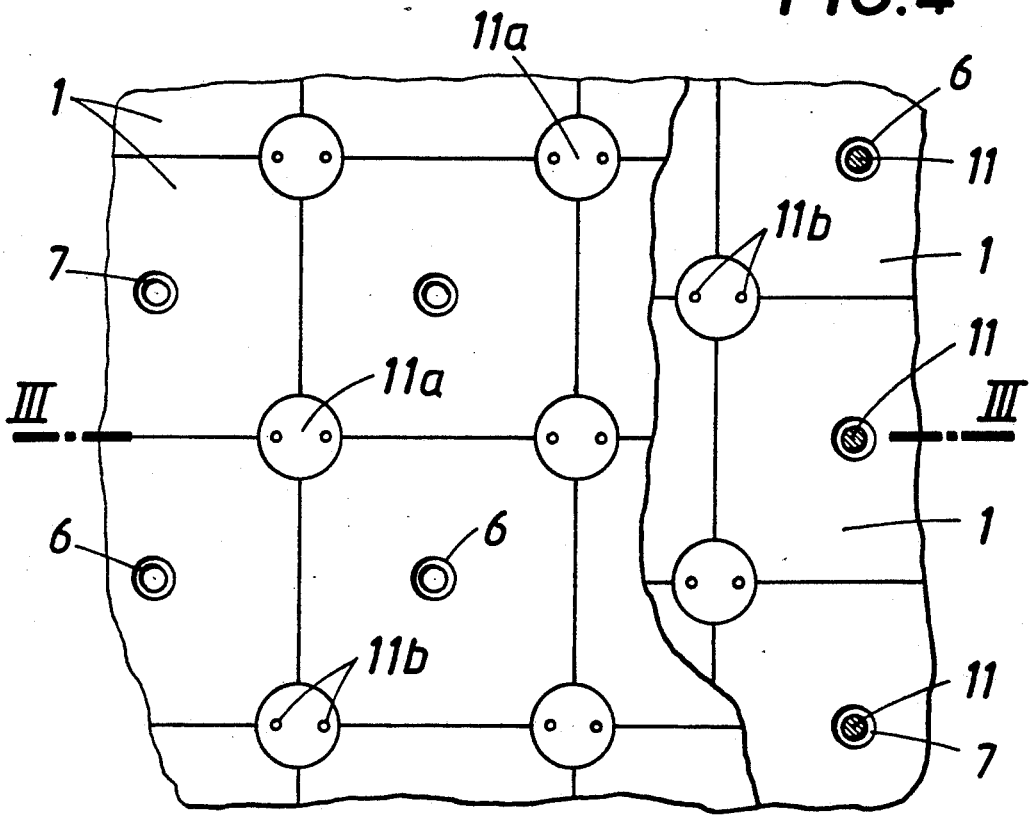

FIGS. 3 and 4 show the floats 1 assembled to form a platform or other assembly consisting of at least two layers and in the illustrated case of three layers 10, 10*a*, 10*b*. In that assembly, adjacent ones of the layers 10, 10*a*, 10*b* are diagonally offset in such a manner to such an extent that the eyes 4 and the retaining openings 6 of the floats of each layer are vertically aligned with the retaining openings 6 and the eyes 4, respectively, of the floats of an adjacent layer and sufficiently long layer-connection bolts 11 can be inserted through the vertically aligned eyes 4 and retaining openings 6 and can be locked in the recesses 5 and on the recessed surfaces of the bearing rings 7. For that purpose each connecting bolt 11 is provided with two locking cams 9, 9*a*, which are associated with the recesses 5 and the bearing rings 7. Adjacent floats 1 of adjacent layers will be held together because each layer-connecting bolt 11 is supported in the recesses 5 associated with the eyes 4 and engages the bearing rings 7 in the retaining openings 6. Because each of the joints between adjacent corners of adjacent floats 1 of a given layer is covered and supported by a float 1 of an adjacent upper or lower layer, the resulting platform is very stable and has a high carrying capacity.

In the example shown in FIGS. 3 and 4 each of the layer-connecting bolts 11 extends only in two adjacent layers of floats and extends from the corner-connecting joints of the upper layer into the retaining openings of the lower layer. Alternatively, layer-connecting bolts may be used which extend through all three layers or which extend from a retaining opening of an upper layer into the eyes of the corner-connecting elements of the lower layer. In a known manner each layer-connecting bolt 11 has a head 11*a*, which covers the associated recesses formed at the top of adjacent corners and the gaps between the adjacent corner edges of the adjacent floats 1 and is formed with holes 11*b* for receiving pins of a tool for rotating the connecting bolt into and out of a locking position. Because the eyes 4 and the openings defined by the bearing rings 7 have the same configuration, each layer-connecting bolt 11 can axially be inserted through the eyes 4 and the bearing rings 7 to a lowermost position defined by the engagement of the downwardly tapered head 11 with the tops of the adjacent floats 1 and can then be rotated in that the head 11*a* is turned by a suitable tool until the locking cams 9 and 9*a* are locked in the recesses 5 and on the recessed surfaces 7.

The float 1 can economically be made and is particularly suitable for use in platforms which consist of two or more layers and have a very high stability and carrying capacity so that such platforms can be used, for instance, in floating bridges having a particularly high carrying capacity.

I claim:

1. A float comprising a generally prismatic-shaped body with a plurality of corners, a connecting element attached to each of said plurality of corners and extending generally horizontally outwardly from said body and having an eye passing vertically through said connecting element and a bottom surface with a recess adjoining said eye, said connecting elements being vertically offset from each other, and a bearing ring located in a central retaining opening in the middle of said body, said opening passing vertically through said body, said bearing ring having a bottom surface with a recess adjoining the open interior of said ring, wherein said eye of said connecting element has a cross sectional shape which is the same as the cross sectional shape of the opening of said bearing ring.

2. A float according to claim 1, wherein said body is a parallelepipedic-shaped body.

3. A float according to claim 1, wherein said body is shaped as a hollow ring which surrounds the central retaining opening.

4. A float according to claim 3, wherein said body is filled with foam.

5. An assembly of floats comprising a plurality of floats having generally prismatic-shaped bodies, each with a plurality of corners, a connecting element attached to each of said plurality of corners and extending generally horizontally outwardly from said body and having an eye passing vertically through said connecting element and a bottom surface with a recess adjoining said eye, said connecting elements being vertically offset from each other, a bearing ring located in a central retaining opening in the middle of each of said bodies, said opening passing vertically through said bodies, said bearing ring having a bottom surface with a recess adjoining the open interior of said ring, a connecting bolt with a lateral projection for forming a layer of floats, said layer including a plurality of said connecting elements arranged so that the eyes are vertically aligned and said connecting bolt passing through the eyes and being locked by placement of said lateral projection in the recess of the lower-most connecting element, a subassembly having a plurality of said layers, each of said layers being offset with respect to its adjacent layer so that the opening of said bearing rings on one of said layers is vertically aligned with the eyes of said connecting elements on at least one adjacent layer, layer-connecting bolts for connecting said layers together to form said assembly, said connecting bolts extending through said bearing rings and through the eyes of said connecting elements of said at least one adjacent layer, said connecting bolts having two lateral projections, one lateral projection locking into the recess of said bearing ring and the other lateral projection locking into the recess of said connecting elements.

6. An assembly according to claim 5, wherein said assembly comprises three layers.

7. An assembly according to claim 5, wherein said assembly includes two layers.

8. An assembly according to claim 6, wherein said layer-connecting bolts extend through said bearing rings of floats, through the eyes of one of said layers and additionally passes through the eyes of said connecting elements of an adjacent layer.

9. An assembly according to claim 5, wherein said layer-connecting bolts have conically-shaped heads for receiving stress created by movement between said adjacent layers, said head forcing said adjacent layers against each other.

* * * * *